US010632038B2

(12) United States Patent
Scappaticci

(10) Patent No.: US 10,632,038 B2
(45) Date of Patent: Apr. 28, 2020

(54) FASCIAL ABRASION TOOL WITH TEXTURED SURFACE

(76) Inventor: Mark J. Scappaticci, Niagra Falls (CA)

( * ) Notice: Subject to any disclaimer, the term of this patent is extended or adjusted under 35 U.S.C. 154(b) by 611 days.

(21) Appl. No.: 13/989,074

(22) PCT Filed: Nov. 28, 2011

(86) PCT No.: PCT/CA2011/001317
§ 371 (c)(1),
(2), (4) Date: Sep. 9, 2013

(87) PCT Pub. No.: WO2012/068680
PCT Pub. Date: May 31, 2012

(65) Prior Publication Data

US 2014/0005581 A1 Jan. 2, 2014

Related U.S. Application Data

(60) Provisional application No. 61/417,352, filed on Nov. 26, 2010.

(51) Int. Cl.
*A61H 7/00* (2006.01)

(52) U.S. Cl.
CPC ..... *A61H 7/003* (2013.01); *A61H 7/001* (2013.01); *A61H 7/007* (2013.01); *A61H 2201/1692* (2013.01); *A61H 2201/1695* (2013.01)

(58) Field of Classification Search
CPC ..... A61H 7/00; A61H 7/002; A61H 7/003; A61H 7/007; A61H 2201/1692; A61H 2207/00
See application file for complete search history.

(56) References Cited

U.S. PATENT DOCUMENTS

| | | | | |
|---|---|---|---|---|
| 3,196,885 A | | 2/1962 | Emerson | |
| 5,269,037 A | * | 12/1993 | White ..... | A45D 34/04 15/104.001 |
| 5,366,437 A | | 11/1994 | Graston | |
| 5,441,478 A | | 8/1995 | Graston | |
| 5,577,997 A | * | 11/1996 | Thariani et al. ..... | 601/135 |

(Continued)

FOREIGN PATENT DOCUMENTS

| | | |
|---|---|---|
| CN | 2391600 Y | 8/2000 |
| WO | 2006075848 | 7/2006 |
| WO | 2010127406 | 11/2010 |

OTHER PUBLICATIONS

International Search Report in PCT/CA2011/001317 dated Jan. 31, 2012.

(Continued)

*Primary Examiner* — Michael J Tsai
(74) *Attorney, Agent, or Firm* — Manelli Selter PLLC; Edward Stemberger

(57) ABSTRACT

A fascial abrasion technique tool is provided having at least one treating surface, wherein the treating surface is provided with a textured surface, so as to assist in massaging the fasica of a patient. The textured surface can be provided by a series of ridges and grooves on the edge surface, but more preferably, is provided by grid-blasting of the edge surface to produce pitting of the edge surface. Preferably, the entire tool is provided with a textured surface. The tool provides improved ability for a therapist to provide fascial abrasion therapy.

20 Claims, 2 Drawing Sheets

(56) References Cited

U.S. PATENT DOCUMENTS

| | | | | |
|---|---|---|---|---|
| 6,077,239 | A * | 6/2000 | Lin | 601/137 |
| 6,126,620 | A | 10/2000 | Graston | |
| 6,641,547 | B2 * | 11/2003 | Sevier | A61H 7/001 134/137 |
| 6,758,826 | B2 * | 7/2004 | Luettgen et al. | 601/73 |
| 7,070,351 | B2 * | 7/2006 | Cooper | B43K 23/008 16/430 |
| D634,022 | S | 3/2011 | Scappaticci | |
| D638,549 | S | 5/2011 | Scappaticci | |
| D681,841 | S | 5/2013 | Scappaticci | |
| 2002/0111573 | A1 * | 8/2002 | Teng | 601/137 |
| 2003/0165550 | A1 | 9/2003 | Rhoades | |
| 2005/0103357 | A1 | 5/2005 | Jo et al. | |
| 2007/0032751 | A1 * | 2/2007 | Roman | A61H 7/003 601/15 |
| 2008/0004554 | A1 | 1/2008 | Smith | |
| 2008/0177207 | A1 * | 7/2008 | Liao | 601/137 |
| 2009/0240177 | A1 * | 9/2009 | Sullivan | 601/136 |
| 2010/0242201 | A1 * | 9/2010 | Linzell | A45D 34/04 15/229.11 |

OTHER PUBLICATIONS

Written Opinion in PCT/CA2011/001317 dated Jan. 31, 2012.
Calm Spiritning Yu Jade, Fish with Wave, Item #GUA-4-W, Mar. 30, 2010, <URL:http://calmspirit.jade_pearls/guasha.html/>t.
European Search Report & Written Opinion in European Patent Application No. 11842726.9 dated Mar. 30, 2016.
Patent Examination Report in Australian Patent Application No. 2011334521 dated Jun. 12, 2015.
Examination Report in EP 11842726.9 dated Nov. 19, 2018.

* cited by examiner

FASCIAL ABRASION TOOL WITH TEXTURED SURFACE

FIELD OF THE INVENTION

The present invention relates generally to an apparatus for use by a therapist to treat soft tissue areas of the body. More particularly, the present invention relates to a fascial abrasion tool (or collection of tools), or the use thereof, having a textured surface for improved contact of the tool with those soft tissue areas of the body to be treated by the tool.

BACKGROUND OF THE INVENTION

Inflammation of soft tissue areas of the human body may occur in many ways. For example, inflammation may occur as the result of a major trauma, such as surgery, or as the result of repeated micro-trauma, such as overtraining. The body responds to such inflammation by forming fibrous adhesions, or scar tissue, as an unavoidable by-product of the healing process. The scar tissue forms in soft tissue areas of the body, such as muscles, tendons, and ligaments, and in the area between the muscle and the connective tissue (fascia). As scar tissue builds up, it prevents the muscles, tendons, and ligaments from properly lengthening and contracting, thereby resulting in lost range of motion, pain, and decreased stability. In addition, the build-up of scar tissue generally causes pain in the affected joint and surrounding areas. This pain often causes the sufferer to believe that an injury still exists; however, in most cases, the injury itself has healed. Therefore, it is desirable to loosen or remodel the scar tissue so that the joint and surrounding tissues may achieve a greater level of performance.

Scar tissue can be broken down or remodeled by various soft tissue therapy techniques, which involves use of the trainer's hand to manually massage the skin over the affected soft tissue areas to release scar tissue adhesions and regain lost resting length in the tissue. This type of massage can include cross-frictional massage, deep muscle massage, and rolfing.

Tools are known in the art for use in this type of massage in order to loosen fibrous scar tissue adhesions from underlying soft tissue of a patient. Such tools are described in, for example U.S. Pat. No. 6,126,620, to Graston. Such devices typically have an elongate rigid body with a first flat surface and a second flat surface opposite from the first flat surface, and a peripheral edge extending about the circumference of the body of tool. A portion of the peripheral edge may be configured in the shape of an arc or series of arcs, corresponding to the various shapes and contours of selected parts of a patient's body, from which a scar tissue adhesion is to be loosened from the underlying soft tissue. A further portion of the peripheral edge can include a tapered surface to define an edge.

However, these prior art devices are made of smooth materials such as steel or other metal products including aluminium, plastics, ceramics, or polished stone products, such as jade, or the like.

While these devices have been successfully used by manual therapists, it would be beneficial to the industry to provide improved fascial abrasion technique (F.A.T.) tools to aid in providing a more effective release of the fibrous adhesions.

SUMMARY OF THE INVENTION

As such, in a first aspect of the present invention, the present invention provides a fascial abrasion technique tool comprising a rigid body having at least one treating surface, wherein at least one treating surface is provided with a textured surface.

In a preferred embodiment, all of the tool is provided with a textured surface.

Further, in one preferred embodiment, the present invention provides a tool comprising an elongate rigid body comprising a first flat surface, and a second flat surface opposite from the first flat surface, and a peripheral edge extending about the circumference of the body of tool between the first and second flat surfaces, wherein all of the tool, or a portion of the peripheral edge, and optionally at least one flat surface, has a textured surface.

In a further aspect, the invention further provides, a method of applying a fascial abrasion technique utilizing a device of the present invention wherein at least one treating surface of the device has a textured surface.

The tool can provide a variety of treating surfaces that can be defined by surface features on the tool, or by the edges of the tool. These can include ridges, hollows, bumps, protrusions, or the like formed on the tool, or can be provided by the edges of the tool. The edges can be formed in any desired shape, including linear shape, curved or arc shaped, but preferably, the edges include a curvilinear portion. The edges, are preferably non-sharp.

Preferably, all of the treating surfaces have a textured surface.

In use, the curvilinear portion of the tool is passed across the skin of the patient in such a manner to cause noninvasive contact of the skin-contacting portion of the tool with the scar tissue adhesion sufficiently to loosen the adhesion from the soft tissue. The textured surface aids to facilitate contact between the tool, and the skin and soft tissue of the patient.

An exemplary implementation of the F.A.T. tool of the present invention provides a tool having an elongate rigid body comprising a first flat surface and a second flat surface opposite from the first flat surface, and a peripheral edge extending about the circumference of the body of tool between the first and second flat surfaces, wherein all or a portion of the peripheral edge, and optionally at least one flat surface, has a textured surface.

In a preferred embodiment, the peripheral edge may be configured in the shape of an arc or series of arcs, corresponding to the various shapes and contours of selected parts of a patient's body, from which a scar tissue adhesion is to be loosened from the underlying soft tissue. The peripheral edge preferably includes a tapered surface to define a preferably, non-sharp, edge.

The F.A.T. tools of the present invention can be made of materials such as steel or other metal products including aluminium, plastics, ceramics, or polished stone products, such as jade, or the like. The textured surface can be integral with the tool so that the textured surface is formed in the structure of the tool itself, or the textured surface can be applied to the tool surface using a suitable adhesive, or the like.

The textured surface can be formed in any suitable manner such as by sand-blasting or more generally, grit-blasting techniques (with suitable grit materials), or the like, to form a pitted surface. Alternatively, the textured surface can be provided by drilling, scraping or cutting of the tool surface to form holes, ridges, valleys, or the like. In this respect, the textured surface can be embossed, or de-embossed onto the appropriate surface of the tool.

The textured surface can be established in an organized pattern, such as in a series of alternating ridges and grooves, or a series of drilled holes, or the like, or can be established in a random pattern, such as that achieved by sand-blasting or grit-blasting the surface of the tool, or by spraying a texturing material (such as sand, quartz or the like) on to the surface of a tool, with an adhesive to hold the texturing material in place.

The textured surface can cover all or part of the tool, but preferably, at least one side or edge of the tool, as a treating surface, has the textured surface. The textured surface can be established so as to have a depth on between 0.05 mm to 2.5 mm, but more preferably, has a depth of between 0.1 mm to 0.75 mm. Different areas on the tool can be provided with textured surfaces having different depths, so that various zones of the tool can have differing textures.

Preferably at least 30% of the treating surface has a textured surface, and more preferably, at least 60% of the treating surface has a textured surface. Most preferably, however, all of the treating surface has a textured surface.

Further, preferably at least 30%, and more preferably, at least 60% of the entire tool, has a textured surface. Still more preferably, essentially all of the treatment surface has a textured surface. As such, in one preferred embodiment, the entire F.A.T. tool is covered with a textured surface.

As a result of providing a textured surface, the tool of the present invention improves the ability of a therapist to locate fibrous adhesions on soft tissue surfaces that may not otherwise be located by hand therapy or prior art devices, and allows the therapist to treat a patient with a massage treatment of the fascia of the patient, and apply greater pressure with greater specificity to the fibrous adhesions to more quickly and efficiently break up, loosen and remodel the adhesions from the soft tissue, with reduced effort by the therapist.

A still further advantage of the present invention is that a set of tools may be utilized to massage any selected soft tissue area of the body, whereby each tool of the set is configured to match the contour of a selected soft tissue area. More preferably, however, a single tool is used having a variety of textures and different arc- or curved-shaped perimeter edges or treating surfaces, that allows the therapist to use a single tool in a number of different applications or treatments.

BRIEF DESCRIPTION OF THE DRAWINGS

Embodiments of this invention will now be described by way of example only in association with the accompanying drawings in which.

DETAILED DESCRIPTION OF THE PREFERRED EMBODIMENTS

Figure 1:
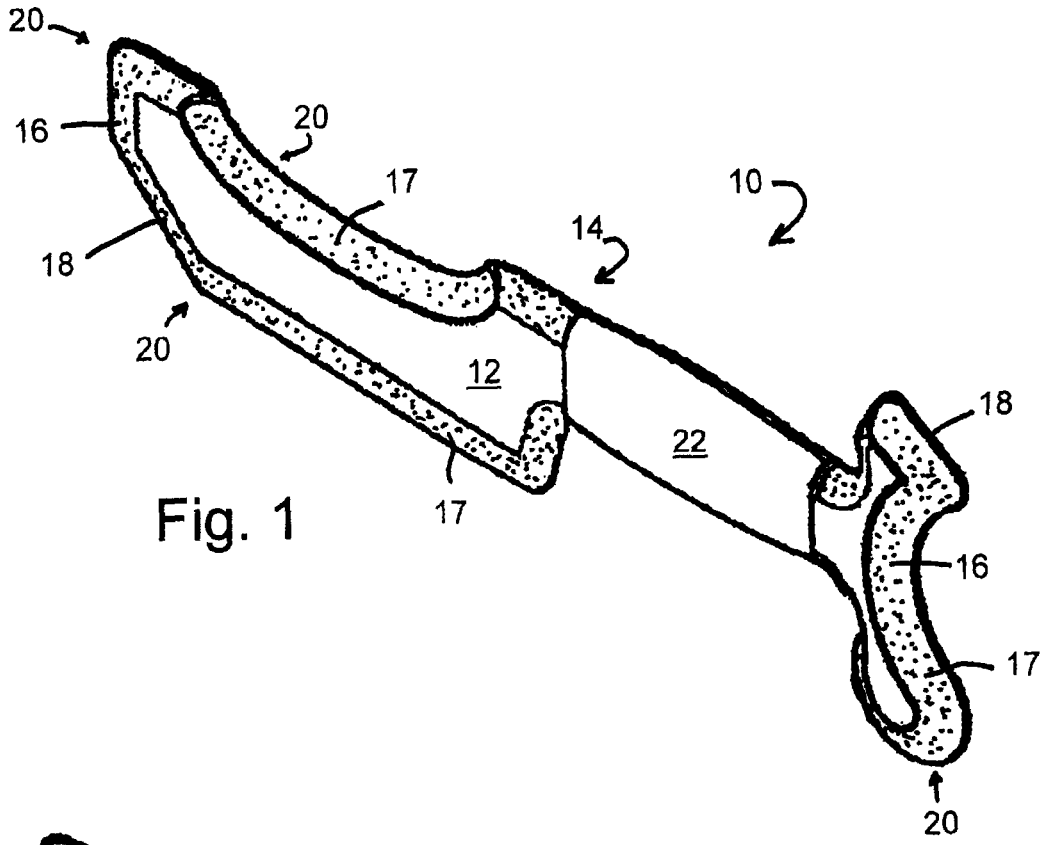
FIG. 1 is a perspective view of a F.A.T. tool of the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a F.A.T. tool 10 is shown. Tool 10 is made of a rigid material, and has a first flat and planar surface 12. Tool 10 is symmetrical so that a second flat and planar surface 14 is present on the opposite side of tool 10.

Peripheral edge surface 16 acts as a treating surface, and extends around portions of tool 10. Surface 16 is located on both sides of tool 10, between first surface 12 and second surface 14. Peripheral edge surfaces 16 define a non-sharp edge 18.

In this embodiment, the surfaces of edge surface 16 have been grid-blasted to form a textured surface 17 with a series of pits formed into the edge surface. The pits have an average depth of 0.5 mm.

The perimeter of tool 10 is formed into various arc- or curved-shaped designs 20 which the therapist can select as appropriate for treatment of the patient, and a handle section 22 can also be provided for use by the therapist.

Figure 2:
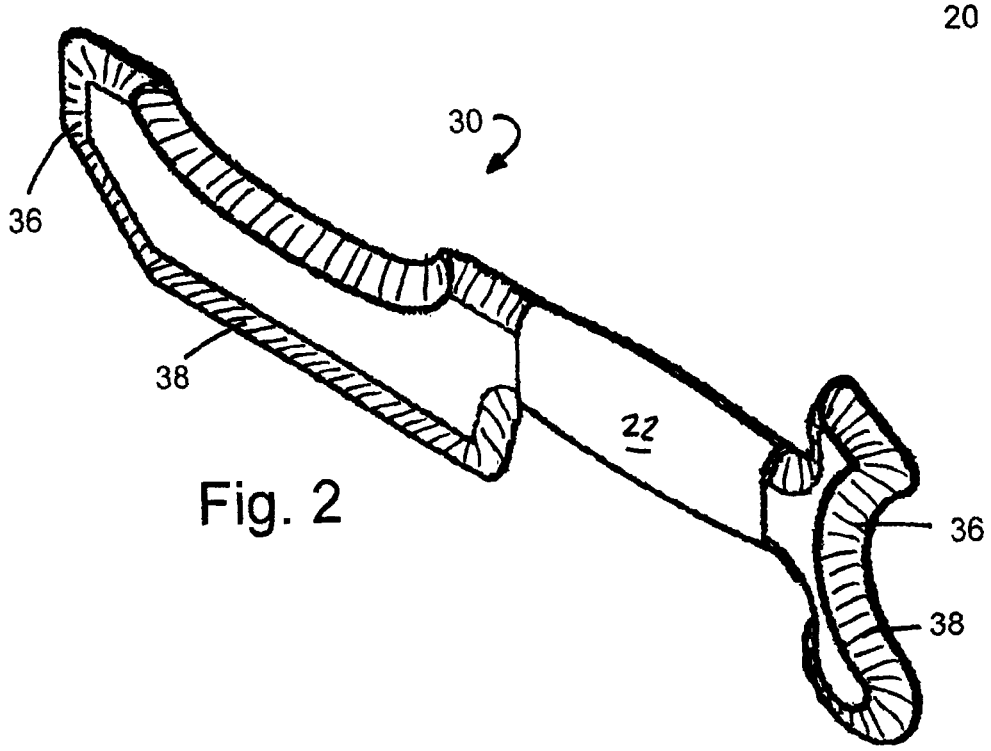
FIG. 2 is a perspective view of a second embodiment of a F.A.T. tool according to the present invention.

In FIG. 2, a similar tool 30 is shown in which edge surface 36 includes a textured surface which has been provided by cutting a series of alternating ridges and grooves 38 into the surface of the edge surface 36. The ridges and grooves 38 are shown as being at an angle of between 30 and 60° with respect to the perimeter of tool 30, but any suitable angle might be used (including being perpendicular to the perimeter of tool 30).

Figure 3:
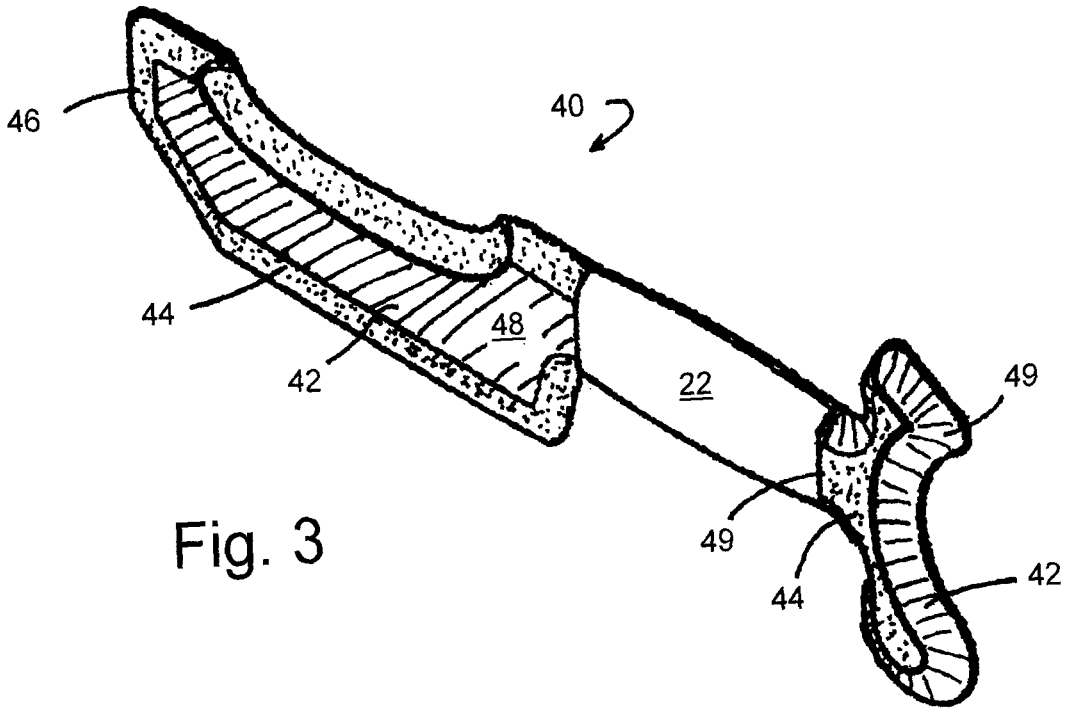
FIG. 3 is a perspective view of a third embodiment of a F.A.T tool of the present invention.

In FIG. 3, a further embodiment of the tool of the present invention 40, is shown, wherein a combination of ridges and grooves 42 and grit-blasted 44 sections of edge surface 46 are shown. A first portion 48 of the first surface, at one end of the tool is also provided shown as including ridges and grooves 42, and a second portion 49 of the first surface, is shown as including a grit-blasted 44 section. The opposite side of tool 40 does not have ridges and grooves or grit-blasted surfaces on first and second portions 48 and 49, so that these areas are smooth.

The therapist has the option of using either flat surface, or edge surface, with either texture, or with a smooth texture, as desired.

Figure 4:
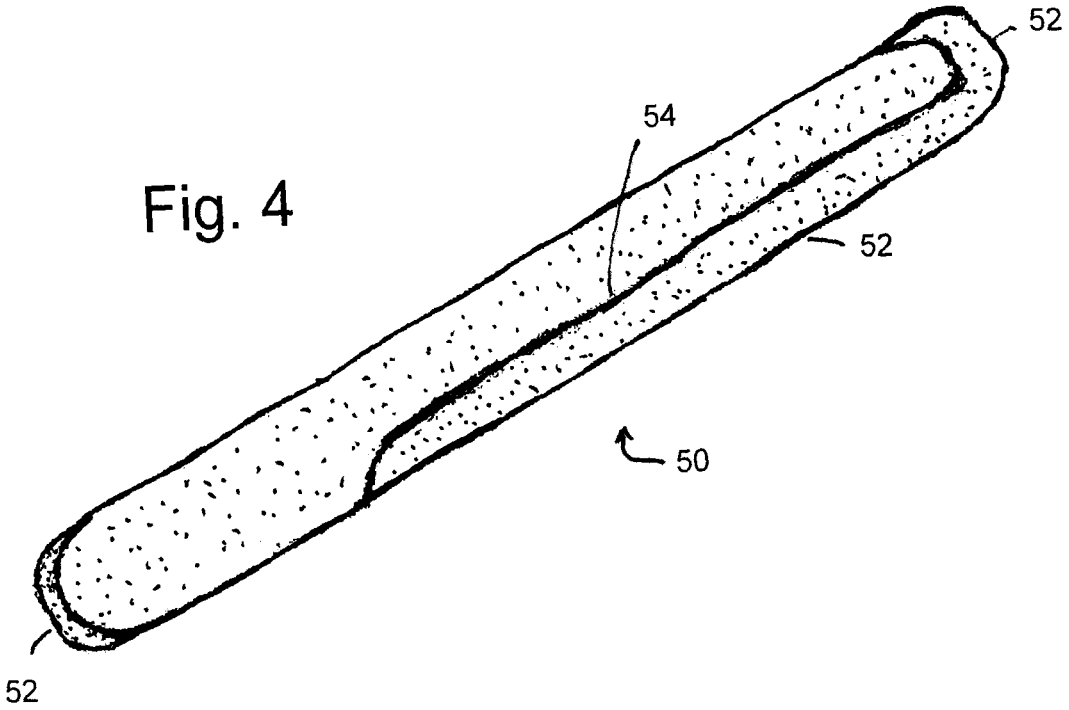
FIG. 4 is a perspective view of a fourth embodiment of a F.A.T. tool of the present invention.

In FIG. 4, a further embodiment of the tool of the present invention 50 is shown, wherein tool 50 is provided with an essentially linear shape, but having various non-sharp edges 52 and ridges 54 which the therapist can select as appropriate for treatment of the patient. Tool 50 is sand blasted with an aluminum grit in order to provide a textured surface having an average depth of 0.5 mm, over the entire tool.

Thus, it is apparent that there has been provided, in accordance with the present invention, a fascial abrasion technique (F.A.T.) tool which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Also, unless otherwise specifically noted, all of the features described herein may be combined with any of the above aspects, in any combination.

Further, use of the terms "he", "him", or "his", is not intended to be specifically directed to persons of the masculine gender, and could easily be read as "she", "her", or "hers", respectively. Similarly, use of terms such as top, bottom sides, front, back, and the like, are used to describe the relative positioning of various components, when the device of the present invention, is used in its normal configuration.

Finally, while this discussion has addressed prior art known to the inventor, it is not an admission that all art discussed is citable against the present application.

What is claimed is:

1. A fascial abrasion technique tool comprising:

an elongate rigid body comprising:

a first flat surface and a second flat surface opposite from the first flat surface;

a peripheral edge extending about the circumference of the body of the tool between the first and second flat surfaces, and, a gripping portion;

wherein said peripheral edge is a non-sharp edge formed in a linear shape, or a curved or arc shape, and all or a portion of said peripheral edge includes at least one treating surface, wherein said at least one treating surface on said peripheral edge is separate from said gripping portion, and has a textured surface, wherein said textured surface acts as a treating surface and has a textured depth of between 0.1 mm to 0.75 mm, and wherein said textured surface acts as a skin-contacting portion of the tool in order to provide non-invasive contact of the treating surface with a patient's skin while the rigid body is held at said gripping portion.

2. A fascial abrasion technique tool as claimed in claim 1 wherein said tool comprises a plurality of skin-contacting treating surfaces on said peripheral edge, and each of said treating surfaces has a textured surface with a textured depth of between 0.1 mm to 0.75 mm.

3. A fascial abrasion technique tool as claimed in claim 2 wherein said treating surfaces are defined by surface features on the tool.

4. A fascial abrasion technique tool as claimed in claim 1, wherein at least 30% of said tool is provided with the textured surface.

5. A fascial abrasion technique tool as claimed in claim 4 wherein all of said tool is provided with the textured surface.

6. A fascial abrasion technique tool as claimed in claim 1 wherein at least one of said first flat surface or said second flat surface are also treating surfaces, and include a textured surface having a texture depth of between 0.1 mm and 0.75 mm.

7. A fascial abrasion technique tool as claimed in claim 6 wherein all or a portion of said peripheral edge surfaces are configured in the shape of an arc or series of arcs.

8. A fascial abrasion technique tool as claimed in claim 1, wherein said tool is constructed of steel, aluminium, plastics, ceramics, or polished stone products.

9. A fascial abrasion technique tool as claimed in claim 8 wherein said polished stone product is jade.

10. A fascial abrasion technique tool as claimed in claim 1, wherein said textured surface is either integral with the tool such that said textured surface is formed in the structure of the tool itself, or wherein said textured surface is applied to the tool surface as a texturing material, by using an adhesive.

11. A fascial abrasion technique tool as claimed in claim 10 wherein said textured surface is established in a random pattern.

12. A fascial abrasion technique tool as claimed in claim 10 wherein said textured surface is integral with said tool, and is formed by sand-blasting or grid-blasting techniques portions of said tool to form a pitted surface.

13. A fascial abrasion technique tool as claimed in claim 10 wherein said textured surface is integral with said tool, and is formed by drilling, scraping or cutting of said tool to form holes, grooves, ridges, or valleys.

14. A fascial abrasion technique tool as claimed in claim 1 wherein different areas on said tool have textured surfaces having different depths.

15. A fascial abrasion technique tool as claimed in claim 1 wherein the peripheral edge surfaces are tapered surfaces.

16. A fascial abrasion technique tool as claimed in claim 1, wherein the gripping portion and the treating surface include the same said textured surface.

17. A fascial abrasion technique tool as claimed in claim 1 wherein said treating surfaces are provided by ridges, hollows, bumps, or protrusions on the tool.

18. A technique for breaking of fibrous scar tissue adhesions from the fascia of a patient, comprising providing non-invasive massaging of the skin and soft tissue of a patient using a textured treating surface of a fascial abrasion technique tool in order to effect enhanced fascial abrasion of the soft tissue of the patient, wherein said fascial abrasion technique tool has an elongate rigid body comprising:

a first flat surface and a second flat surface opposite from the first flat surface;

a peripheral edge extending about the circumference of the body of the tool between the first and second flat surfaces, and, a gripping portion;

wherein said peripheral edge is a non-sharp edge formed in a linear shape, or a curved or arc shape, and all or a portion of said peripheral edge includes at least one treating surface, wherein said at least one treating surface on said peripheral edge is separate from said gripping portion, and has a textured surface, wherein said textured surface acts as a treating surface and has a textured depth of between 0.1 mm to 0.75 mm, and wherein said textured surface acts as a skin-contacting portion of the tool in order to provide non-invasive contact of the treating surface with a patient's skin while the rigid body is held at said gripping portion and wherein said at least one skin-contacting treating surface is configured to provide non-invasive contact with the patient's skin during massaging of the skin and soft tissue, while the rigid body is held at the gripping portion.

19. A technique as claimed in claim 18, wherein said technique comprises non-invasive massaging of the skin and soft tissues of a patient using a collection of differing fascial abrasion technique tools.

20. A technique as claimed in claim 18, wherein the gripping portion and the treating surface include the same said textured surface.

* * * * *